123-73 SR
12/18/79 OR 4,178,887

United States Patent [19] [11] 4,178,887
Iida [45] Dec. 18, 1979

[54] INTAKE DISTRIBUTOR FOR TWO-CYCLE INTERNAL COMBUSTION ENGINES

[75] Inventor: Kazumi Iida, Iwata, Japan

[73] Assignee: Yamaha Hatsudoki Kabushiki Kaisha, Iwata, Japan

[21] Appl. No.: 841,525

[22] Filed: Oct. 12, 1977

[30] Foreign Application Priority Data

Oct. 13, 1976 [JP] Japan ..... 51-138058

[51] Int. Cl.[2] ..... F02B 33/04
[52] U.S. Cl. ..... 123/73 V; 123/59 B; 123/73 A
[58] Field of Search ..... 123/73 A, 73 U, 59 B, 123/52 M

[56] References Cited

U.S. PATENT DOCUMENTS

| | | | |
|---|---|---|---|
| 2,224,900 | 12/1940 | Conover | 123/73 A |
| 2,227,247 | 12/1940 | Conover | 123/52 M |
| 2,264,365 | 12/1941 | Conover | 123/73 A |
| 2,289,201 | 7/1942 | Martin | 123/73 V |
| 2,973,752 | 3/1961 | Torre | 123/73 V |
| 3,170,449 | 2/1965 | Goggi | 123/73 A |
| 3,529,173 | 7/1971 | Frehe | 123/59 B |
| 3,859,967 | 1/1975 | Turner et al. | 123/73 A |

FOREIGN PATENT DOCUMENTS 52-35370 of 1977 Japan .

*Primary Examiner*—Charles J. Myhre
*Assistant Examiner*—David D. Reynolds
*Attorney, Agent, or Firm*—Donald D. Mon

[57] ABSTRACT

An intake gas distributor extending from one carburetor to a pair of two-cycle internal combustion cylinders. The cylinders are horizontal and arranged one above the other. The distributor is bifurcated, and its branches are proportioned and arranged so that air/fuel mixture in substantially equal quantity and density flows to both cylinders, despite the inherent tendency of fuel to settle out of the mixture, especially at low load conditions.

4 Claims, 3 Drawing Figures

INTAKE DISTRIBUTOR FOR TWO-CYCLE INTERNAL COMBUSTION ENGINES

The invention relates to improvements in an intake gas distributor for use in a two-cycle internal combustion engine of the type including two cylinders arranged one directly above the other, the distributor supplying an intake gas from a carburetor to the respective cylinders.

It has been found that when known distributors of the above described type air/fuel mixture will be supplied into the lower cylinder and a leaner air/fuel mixture will be supplied into the upper cylinder due to the weight of the mixture. This results in poor engine output power. This is true particularly when the engine is operating at a low rate, when poor fuel atomization is poor. These problems become serious particularly in engines of the type with high output power when the engine is operating at a low rate.

Therefore, the present invention has for its object to provide an improved two-cycle internal combustion engine which will be free from the above described disadvantages found in the conventional engines and which will be effective to supply substantially the same density and quantity of air/fuel mixtures into the upper and lower cylinders to thereby provide superior engine output power. This is accomplished in accordance with the present invention by providing an intake gas distributor arrangement such that the inlet of the intake gas distributor is positioned near the upper passage and far away from the lower passage and the upper passage has its down stream end reduced in diameter.

One embodiment of an outboard two-cycle internal combustion engine equipped with an intake gas distributor made in accordance with the present invention will now be described by way of example, with reference to the accompanying drawings in which.

Figure 1:
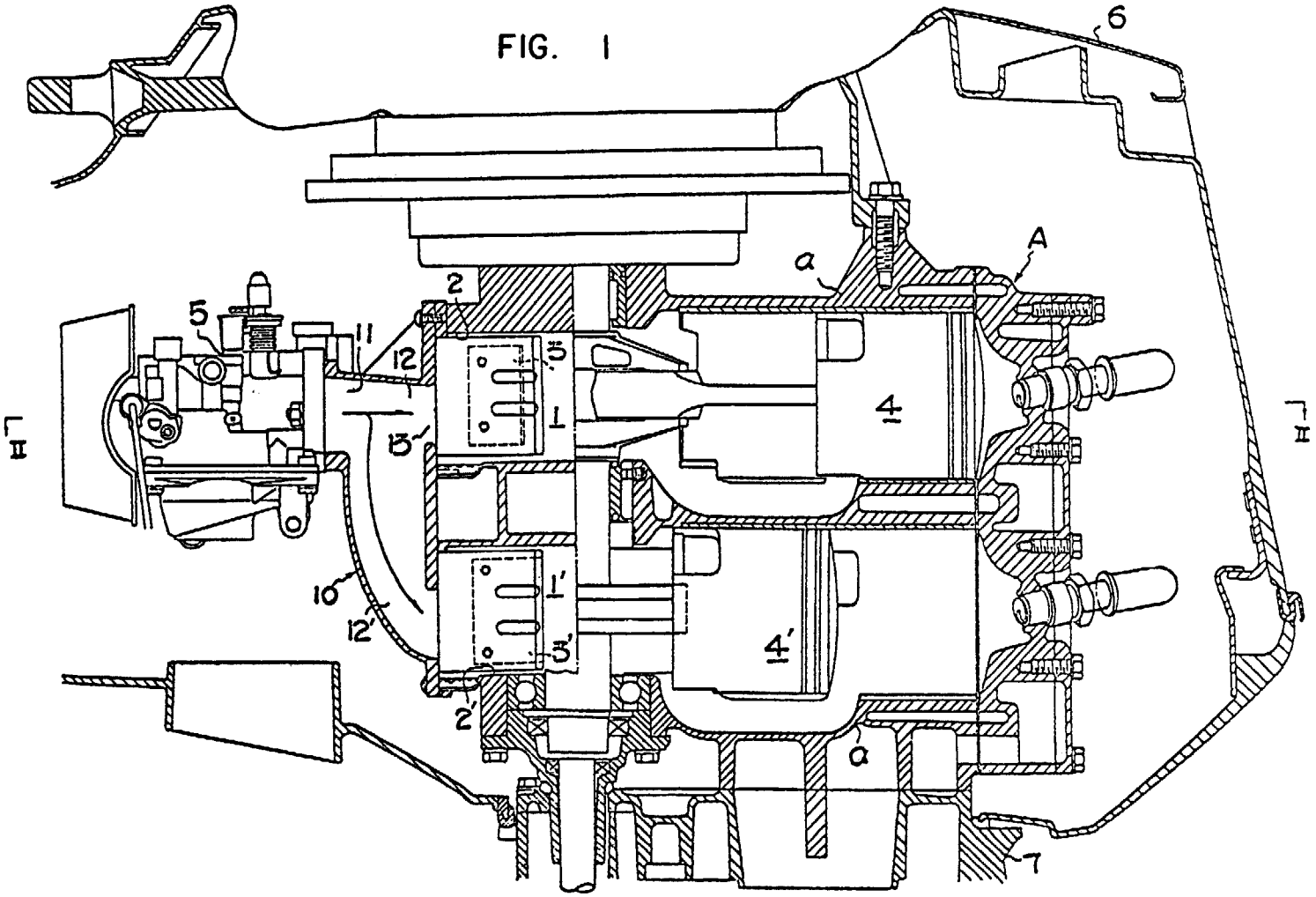
FIG. 1 is a side elevation, principally in axial cross-section, showing the presently preferred embodiment of the invention, taken at line 1—1 in FIG. 2.
Figure 2:
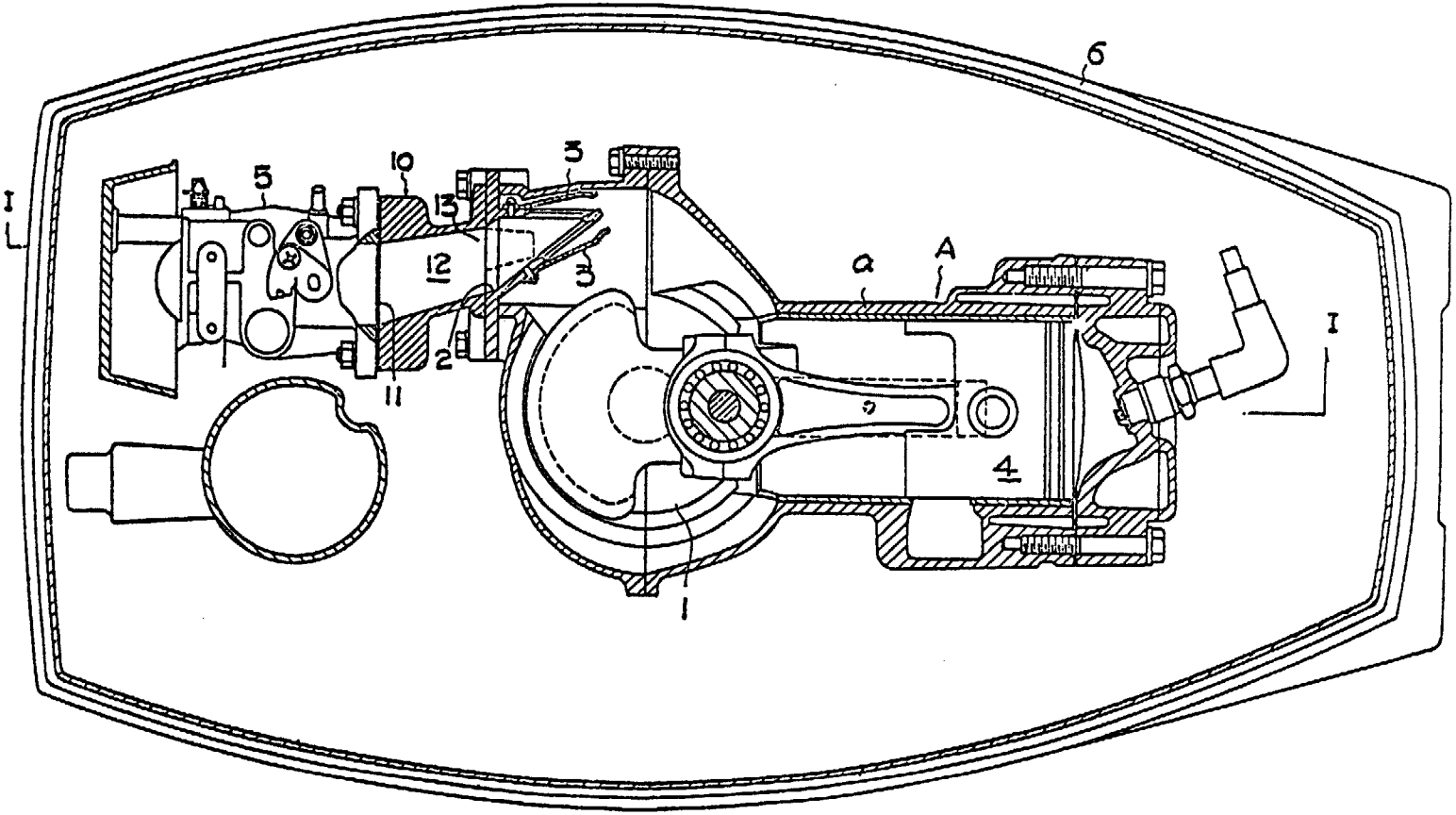
FIG. 2 is a horizontal cross-section taken at line 2—2 in FIG. 1.

In FIG. 1, the reference letter (A) designates a two-cycle internal combustion engine including two horizontal cylinders (a) and (a') arranged one directly above the other. The reference numerals 1 and 1' indicate crankcases, the numerals 2 and 2' intake ports, the numerals 3 and 3' reed valves, the numerals 4 and 4' pistons, the numeral 5 a carburetor, the numeral 6 an engine cowling, and the numeral 7 a casing.

The reference numeral 10 designates an intake gas distributor which has its inlet 11 connected to the carburetor 5 and is bifurcated to form upper and lower passages 12 and 12' respectively connected to the intake ports 2 and 2' of the upper and lower cylinders (a) and (a'), whereby an air/fuel mixture flowing from the carburetor into the inlet 11 is supplied through the upper and lower passages 12 and 12' into the upper and lower cylinders (a) and (a'), respectively, during the intake stroke of the engine.

The inlet 11 of the intake gas distributor 10 is located near the upper passage 12 coaxially therewith so that the mixture flow through the inlet 11 can be supplied directly into the upper cylinder (a) during the intake stroke of the engine.

The lower passage 12' has its one end connected to the upper passage 12 on the way thereof and is extended downward to the lower cylinder so as to have an increased length in comparison with the upper passage 12. This increases the resistance of the mixture flow through the lower passage. The increase in mixture flow resistance can be adjusted by properly selecting the diameter of the lower passage at its downstream end. The difference in mixture flow resistance between the upper and lower passages 12 and 12' can be compensated by reducing the diameter of the upper passage at its down-stream end 13 to increase the resistance of the mixture flow through the upper passage 12.

It can be seem from the foregoing description that the inlet of the intake gas distributor is positioned near the upper passage and far away from the lower passage so that an air/fuel mixture flowing from the carburetor can be supplied directly into the upper cylinder during the intake stroke of the upper engine without the fuel falling down into the lower passage due to its weight thereby permitting to supply substantially the same density of air/fuel mixture into the upper and lower cylinders.

Furthermore, the upper passage has its diameter reduced at its downstream end to compensate for the gas flow resisatnce difference between the upper and lower passages resulting from the inlet of the intake gas distributor positioned near the upper passage and far away from the lower passage thereby permitting supply of substantially the same amount of air/fuel mixtures into the upper and lower cylinders.

For this purpose, the inlet may be positioned coaxially with the upper passage or may be inclined toward the upper passage so that the air/fuel mixture flowing from the carburetor can be introduced toward the upper passage.

Figure 3:
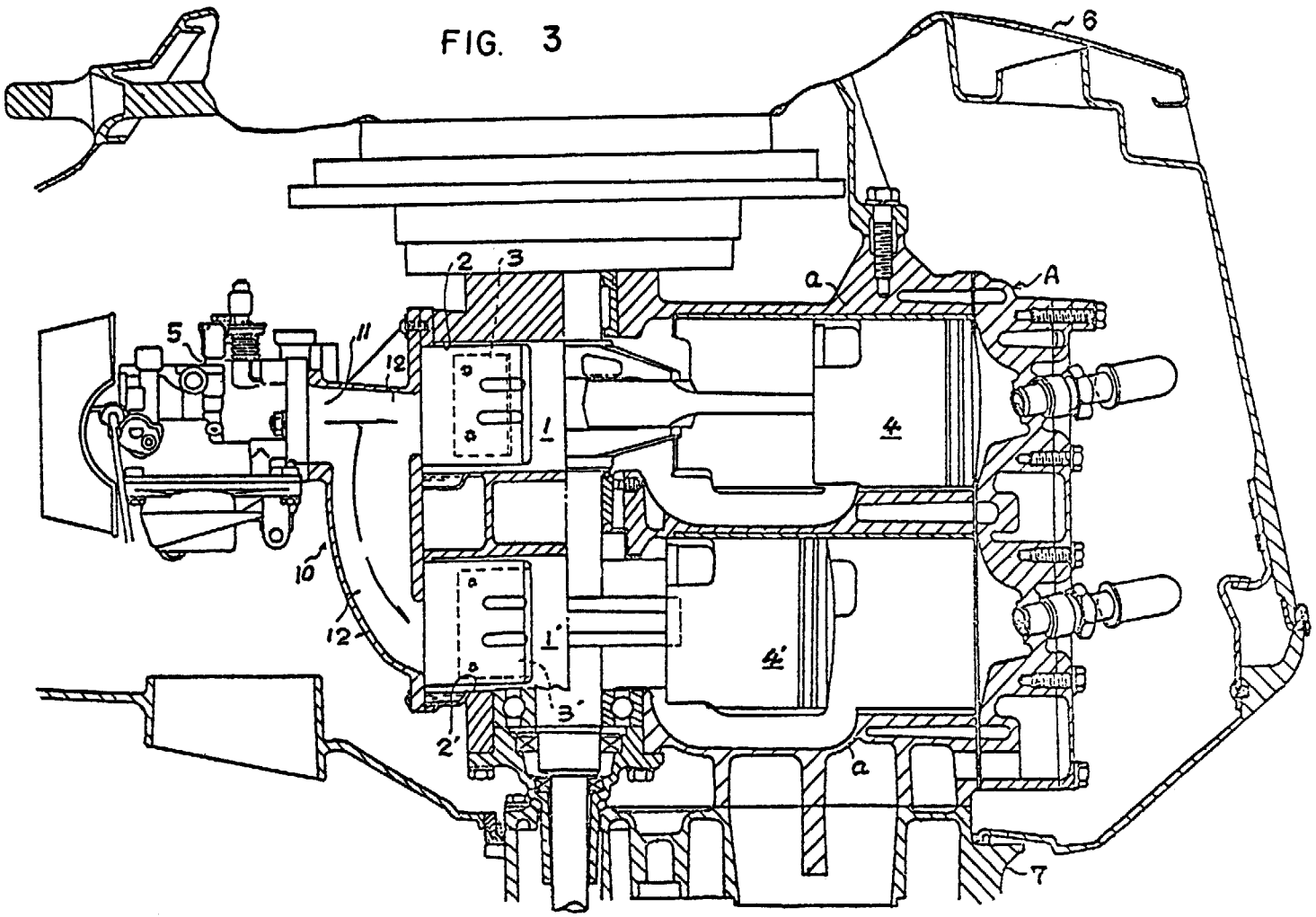
FIG. 3 is a fragmentary cross-section similar to FIG. 1, showing a modification of the invention.
Figure 4:
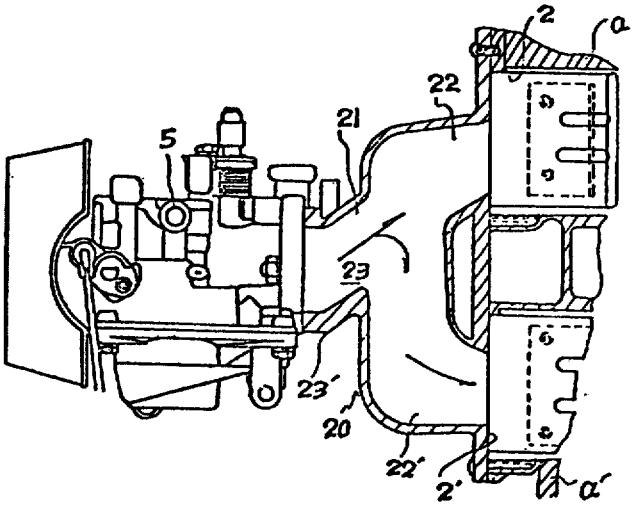

FIG. 3 illustrates an alternative embodiment according to the present invention in which the reference numeral 20 designates an intake gas distributor. The intake gas distributor 20 is bifurcated to form upper and lower passages 22 and 22' arranged synmetrically and the inlet 21 of the intake gas distributor 20 is inclined toward the upper passage 22 so that the mixture flow can be introduced toward the upper passage 22.

In accordance with the present invention, since the inlet of the intake gas distributor is positioned near the upper passage and far away from the lower passage, the air/fuel mixture flowing from the carburetor can be supplied directly into the upper cylinder during the intake stroke of the upper engine without the fuel falling down into the lower passage due to its weight.

It is therefore apparent that there has been provided, in accordance with the present invention, an improved intake gas distributor for a two-cycle internal combustion engine which is free from the disadvantages found in the conventional engine and which can supply the same density of air/fuel mixtures into the upper and lower cylinders to provide a superior engine output power when the engine is operating at a low rate.

What is claimed is:

1. In combination with a two-cyclinder, two-cycle internal combustion engine, whose cylinders are substantially horizontal, and one of which lies directly above the other, each of said cylinders having a cylinder inlet port to receive air/fuel mixture to be combusted in the respective cylinder, an intake gas system comprising: only one carburetor for providing an air/fuel mixture for both of said cylinders; and a distributor comprising a conduit having a distributor inlet port receiving air/fuel mixture from said carburetor, and two branches, each leading to a respective one of said cylinder inlet ports, said distributor inlet port being disposed at an elevation nearer the upper one of the cylinder inlet ports, the cross-section of the cylinder inlet ports, the direction of flow from the distributor inlet port, and the length and cross-section of the branches being such as to provide substantially equal quantities of air/fuel mixture of substantially equal density to the two cyinder inlet ports in which the cross-section of the upper cylinder inlet port is smaller than the cross section of the lower cylinder inlet port.

2. A combination according to claim 1 in which the axis of the distributor inlet port is substantially directly aligned with the axis of the upper cylinder inlet port.

3. A combination according to claim 1 in which the length of the branch leading to the lower cylinder inlet port is substantially greater than the length of the branch leading to the upper cylinder inlet port.

4. A combination according to claim 1 in which the axis of the distributor inlet port is obliquely upward, and in which said upper branch constitutes a continuation thereof, the lower branch departing downwardly therefrom.

* * * * *